United States Patent [19]

Shell

[11] Patent Number: 4,903,928

[45] Date of Patent: Feb. 27, 1990

[54] BRACKET ARRANGEMENT

[75] Inventor: Irving W. Shell, Pompano Beach, Fla.

[73] Assignee: Friedkin Industries, Inc., Boca Raton, Fla.

[21] Appl. No.: 212,162

[22] Filed: Jun. 23, 1988

Related U.S. Application Data

[63] Continuation of Ser. No. 19,646, Feb. 27, 1987, abandoned.

[51] Int. Cl.[4] ..... A47B 96/06

[52] U.S. Cl. ..... 248/225.1; 248/245; 211/153

[58] Field of Search ..... 248/225.1, 244, 245, 248/231.3, 243, 242; 211/192, 153; 108/110, 107, 144

[56] References Cited

U.S. PATENT DOCUMENTS

| | | | |
|---|---|---|---|
| 982,279 | 1/1911 | Knape | 248/244 |
| 2,788,902 | 4/1957 | Nowicki | 248/243 X |
| 3,250,584 | 5/1966 | Tassell | 248/245 X |
| 4,065,088 | 12/1977 | Shell | 248/242 |
| 4,677,794 | 7/1987 | Parron et al. | 248/222.3 |
| 4,708,311 | 11/1987 | Clausen et al. | 248/225.1 |

FOREIGN PATENT DOCUMENTS

| | | | |
|---|---|---|---|
| 0048225 | 3/1982 | European Pat. Off. | 248/225.1 |
| 2752580 | 5/1979 | Fed. Rep. of Germany | 248/245 |
| 17336 | of 1906 | United Kingdom | 248/243 |
| 224092 | 11/1924 | United Kingdom | 248/242 |

OTHER PUBLICATIONS

Visual Concepts, Inc. brochure entitled, "Display Fixtures".

Trim Line Design, Inc., brochure entitled, "Architectural Display System".

*Primary Examiner*—Ramon S. Britts

*Assistant Examiner*—Karen J. Chotkowski

*Attorney, Agent, or Firm*—Richard Saccocio

[57] ABSTRACT

An improved bracket arrangement for a slotted wall system is disclosed. The arrangement provides for vertically positioning the bracket regardless of the angle of the slots along the wall. A rotatable positioning bar is attached to the back of the bracket which allows the bar to be positioned transverse to the longitudinal axis of the slot while the bracket is maintained in a vertical orientation. Cam means are used to wedge the bar of the bracket and the back of the bracket between the slot and the face of the wall.

10 Claims, 3 Drawing Sheets

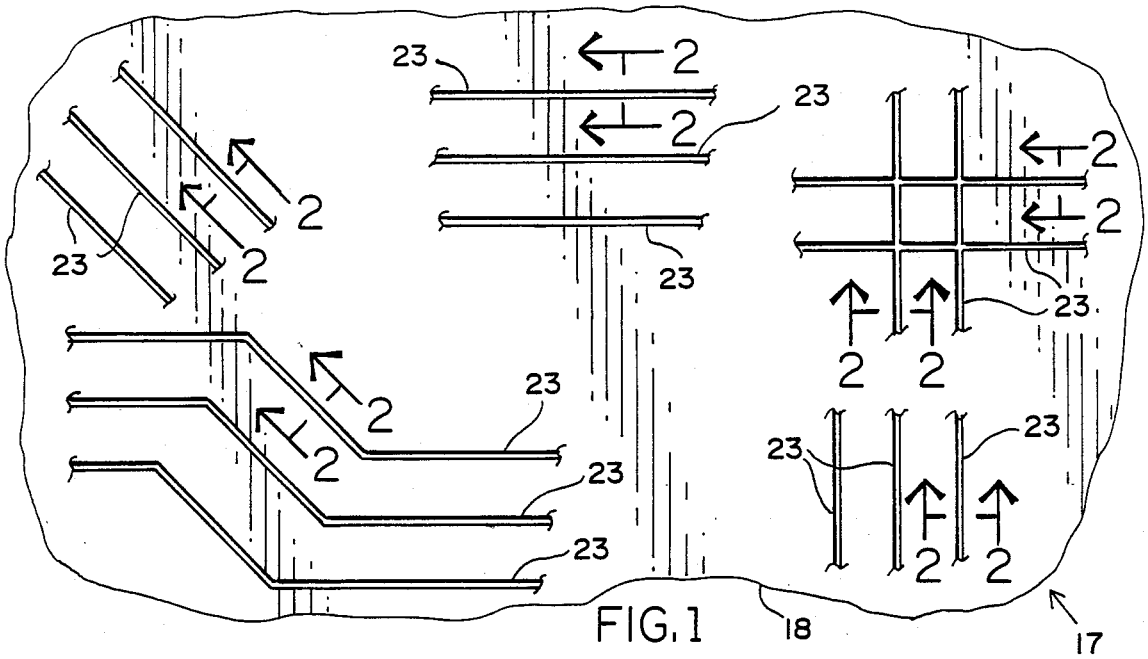
FIG. 1
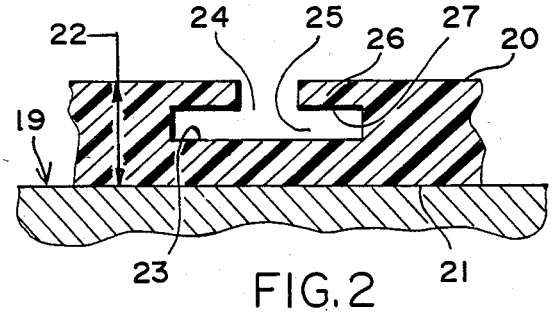
FIG. 2
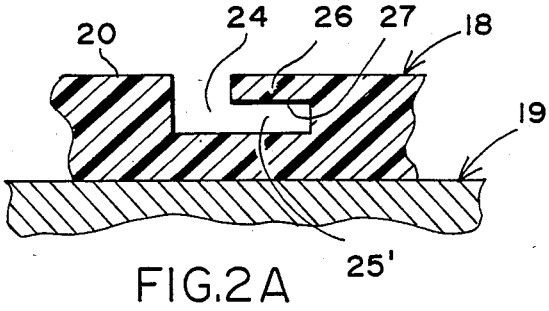
FIG. 2A
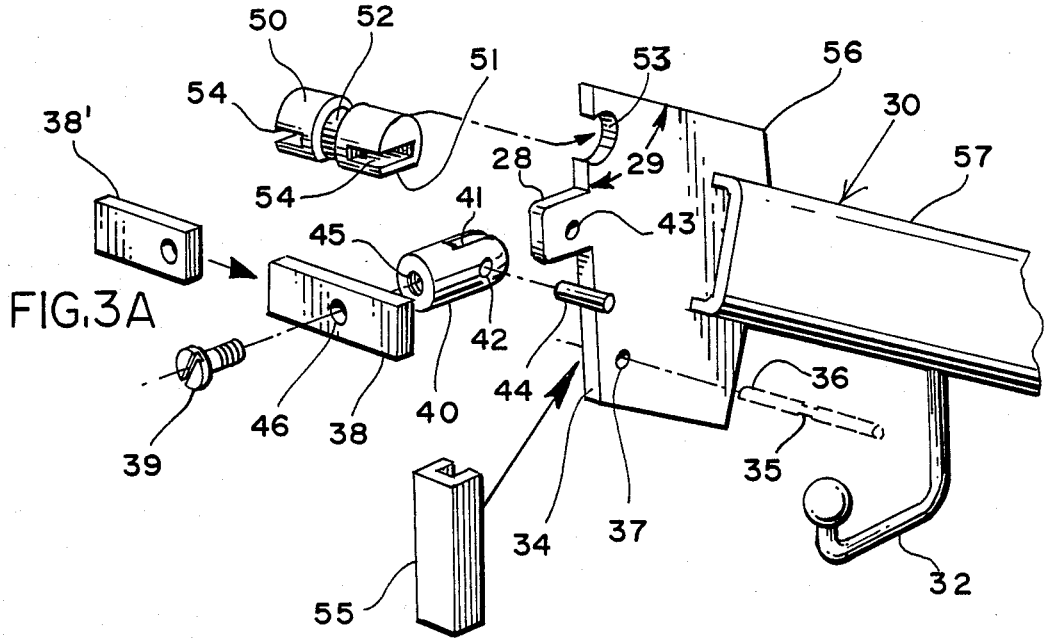
FIG. 3A
FIG. 3

BRACKET ARRANGEMENT

This application is a continuation of application Ser. No. 07/019,646, filed on Feb. 27, 1987 now abandoned.

BACKGROUND OF THE INVENTION

1. Field of the Invention

The present invention relates in general to the field of bracket arrangements used with slotted wall systems and in particular to the field of bracket arrangements which are vertically oriented relative to a slotted wall system which slots are arranged in a vertical direction, in a horizontal direction, or any angled direction therebetween.

2. Description of the Prior Art

As relates to the present invention, the prior art is exemplified in my U.S. Pat. No. 4,065,088, entitled "Upright and Bracket Arrangement" issued Dec. 27, 1977. In this patent I pointed out that many of the prior art brackets and wall systems utilized uprights having vertically spaced notches for engaging the brackets. I further noted in the prior art that such brackets and upright support members had limited capability for adjusting the incline or the angle of the bracket for supporting an inclined shelf. Also, that the position of the bracket along the upright support member was restricted by the number of and the spacing between the notches and did not lock securely to the upright support members. In overcoming those problems of the prior art, I disclosed new and unique upright support members and bracket arrangements which utilizes a cam connector in conjunction with a pair of vertically spaced rods connected to and oriented transverse to the plane of the bracket. One of the rods fit within a vertical T-shaped slot of the upright support member while the other fits against the outside surface of the upright support member. The cam connector is also positioned in a vertically spaced relationship with the two rods and oriented in a similar transverse direction. When the cam connector is rotated it results in the outside rod fitting firmly against the outside surface of the upright support member and the inside rod fitting firmly against the inside surface of the cutout slot of the upright support member such that the bracket is securely connected to the upright support member. By simply angling the back edge of the bracket and the horizontal position of the rods, a bracket arrangement was disclosed which provides for mounting a bracket to an upright support member at any angle desired relative to the horizontal. By attaching shelves to the angled brackets, a shelf arrangement results having shelves which are also angled to the horizontal; or, the brackets themselves can be of the so-called "waterfall" type which do not use shelves but provide for hooking attachment of a number of items thereto in a downwardly angled manner.

While my aforesaid patent provided a bracket arrangement which provided a simple and secure bracket that may be positioned horizontally or in any downwardly slanted or inclined position, such bracket arrangement is generally limited for use with vertical upright support members. Today's decorators and interior designers are utilizing wall panels which incorporate slots in place of upright support members for use with brackets such that the entire wall panel becomes a shelving arrangement. Such wall systems provide a much cleaner and aesthetically pleasing look than a plurality of upright channels or support members fastened to a wall in a side-by-side array. Furthermore, the present-day slotted wall systems are not necessarily arranged in a strictly horizontal or strictly vertical direction. The slots are also provided diagonally at various angles relative to the horizontal or vertical. In some cases the slots may even be angled along two or more different diagonal angles. The use of my aforementioned innovative bracket arrangement functions very well with either the vertical or horizontal slots of the modern-day slotted wall systems but not necessarily so with the diagonally slotted arrangements. On the other hand, the previous prior art brackets are substantially inappropriate in many ways for use with the modern-day wall systems.

Accordingly, it is a primary object of the present invention of the present invention to provide an improved bracket arrangement which may be used with a slotted wall system having slots which range from the vertical to the horizontal and at any diagonal angle therebetween, whereby the plane of the bracket is along a vertical plane.

Another object of the present invention is to provide a bracket arrangement which may be sloped at any downward angle relative to the horizontal and be applied to modern-day wall slotted systems.

Another object of the present invention is to provide a bracket arrangement whereby a plurality of brackets may be oriented parallel to each other in a vertical direction regardless of the angle of the slots within a slotted wall system so as to provide a horizontal shelf.

Another object of the present invention is to provide a bracket arrangement having brackets oriented along vertical planes within a diagonally or otherwise angled slotted wall system, yet which allows for ease of installation.

Yet another object of the present invention is to provide a vertically oriented bracket arrangement for a diagonally or otherwise angled slotted wall system which allows the location of the brackets to be easily adjusted on site, nothwithstanding the angle of the slots of the wall system.

The above-stated objects as well as other objects which although not specifically stated, but are intended to be included within the scope of the present invention, are accomplished by the present invention and will become apparent from the hereinafter set forth detailed description of the invention, drawings, and the claims appended herewith.

SUMMARY OF THE INVENTION

The present invention comprises an improved bracket arrangement for use with an angled, vertical or horizontal slotted wall system. The improved bracket arrangement includes a cam connector in conjunction with an adjustable bar vertically spaced from the cam connector. The back of the bracket provides support for the bracket by resting upon the outside surface of the wall system. In vertically arranged slotted wall systems, a transversely positioned rod may be used to provide such bracket support. The adjustable bar is attached to the back edge of the bracket by a fitting interconnected between the two members. The adjustable bar is positionable such that it is transverse to the axis of the slot within which it is to be placed, regardless of the angle of the slot, while the bracket is oriented in a vertical position. The cam connector provides a means to firmly cinch the adjustable bar and either the back of the bracket or the nonadjustable rod between two different but parallel surfaces of the wall system so as to firmly connect the bracket thereto in a vertical direction.

The adjustability provided by the adjustable bar allows the use of a single bracket arrangement with an angled slotted wall system having any number of differing or diagonally angled slots regardless of the degree of angularity of the slots. The improved bracket arrangement further provides for the vertical connection of brckets which slope in a downwardly inclined direction of any desired angle.

Various other objects, advantages and features of the invention will become apparent to those skilled in the art from the following discussion taken in conjunction with the following drawings, in which:

BRIEF DESCRIPTION OF THE DRAWINGS

FIG. 1 illustrates a number of different slot orientations which may be incorporated within a wall panel attached to a vertical wall, any of which the present improved bracket arrangement may be used;

FIG. 2 is a cross-sectional view of any of the slots of FIG. 1 taken along the line 2—2 thereof;

FIG. 2A is a cross-sectional view of another embodiment of any of the slots of FIG. 1 taken along the line 2—2 thereof;

FIGS. 3 and 3A illustrate, in an exploded view, the details of the bracket of FIG. 4;

DESCRIPTION OF THE PREFERRED EMBODIMENTS

Figure 4:
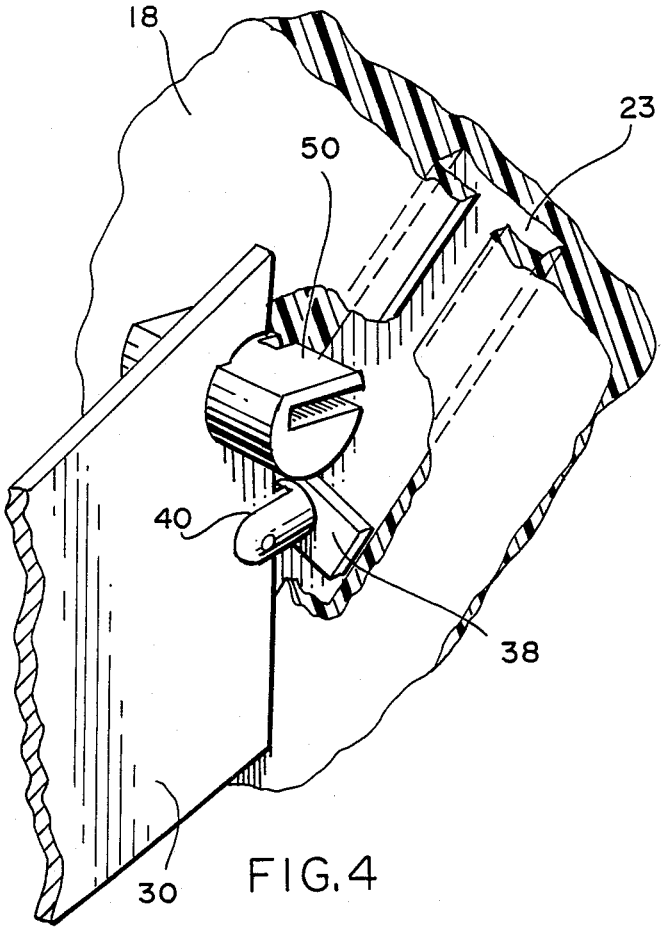
FIG. 4 is an isometric view of the improved bracket arrangement according to the present invention as applied to an angled slot of an angled slotted wall system.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings wherein like characteristics and features of the present invention shown in the various figures are generally designated by the same reference numerals.

FIG. 1 is a schematic rendition of the various slot orientations within a modern wall system 17 as used today by many interior designers. The angled slots are, of course, intended to be used with brackets which in turn may be used for shelves or hooks or the like for the purpose of displaying various and sundry goods attached to the wall. As used in this specification, the phraseology "angled slots" or any variation thereof is intended to mean the slots within a wall or within a wall panel attached to a wall, with the longitudinal axis of the slots oriented along any horizontal, vertical line or any diagonally angled line therebetween. Hence, angled slots refer to slots 23 within a wall or a wall panel 18 similar to those partially shown in FIG. 1 at locations A, B, C, D, and E or any variation or combination thereof. In cross section, any one slot 23 may be similar to a "T" slot as depicted in FIG. 2, an "L" slot as depicted in FIG. 2A or any other such slot having a narrow opening.

In FIGS. 2 and 2A where a wall panel 18 is shown attached to a wall 19, surface 20 comprises the front of the wall panel 18 while surface 21 comprises the back surface of the wall panel 18. The thickness 22 of wall panel 18 may be of the order of five-eighths to seven-eights of an inch thick or even thicker if desired. The entrance or opening 24 to slot 23 is narrower in width than the back portion 25 of slot 23. Opening 24 is located relative to the back open portion 25 such that one or more overhanging flanges 26 are provided. Since a relatively narrow opening portion 24 is all that is generally visible when viewing the wall panel 18 from the outside thereof, the arrangement of slots 23 within the wall panel 18 form a geometric pattern which tends to be aesthetically pleasing. Some examples of these patterns are shown in FIG. 1. Yet, such slots 23 are extremely functional in enabling the attachment thereto of a bracket arrangement such as that disclosed by the present invention. Wall panel 18 is, as noted above, intended to be placed against any vertical wall 19 within a structure which may thereafter be used for display purposes by attaching a bracket arrangement thereto and placing goods on the bracket arrangement.

Reference is now made to FIGS. 3, 3A and 4 of the drawings which show various details of several embodiments of the improved bracket arrangement in an exploded view and as applied to a diagonally or horizontally angled slot 23 of an angled slotted wall system 17. Bracket 30 may be used to support a horizontal shelf 31 or a plurality of hooks 32, with the former being shown in phantom in FIG. 4 bracket 30. Accordingly, brackets 30 may comprise waterfall type of brckets or "standard" shelf type brackets or any other type of well known bracket. Brackets 30 may be attached to a wall panel 18 with the upper edge 33 positioned horizontally or inclined downwardly at any desired vertical angle along wall panel 18. The main plane of bracket 30 is, however, always positioned along a vertical plane perpendicular to wall panel 18. Since back edge 34 rests against surface 20 of wall panel 18, one way to angle bracket 30 downward is to make the included angle 29, between back edge 34 and top edge 33, an acute angle. Hence, the value of the included angle 29 between top edge 33 and back edge 34 determines the downward (or even upward) slope of bracket 30. The phantom line 34' in FIG. 3 illustrates the back edge of a bracket which is more downwardly sloping than that provided by back edge 34 of bracket 30.

An adjustably positionable bar 38 in combination with screw 39 and connector post 40 comprise the means by which bracket 30 may be oriented in a vertical plane regardless of the actual angle of slot 23 relative to wall panel 18. Connector post 40 comprises a member which may be cylindrical or rectangular having a slot 41 extending partially therethrough for receiving therein the back portion of bracket 30. Apertures 42 and 43 in post connector 40 and bracket 30, respectively, allow for attachment of post connector 40 to bracket 30 by means of a pin 44 which simultaneously fits within apertures 42 and 43. The point of connection of connector 40 to bracket 30 may be extended from the back edge 34 as shown in FIG. 3 by means of an extension 28 extending from back edge 34. The extended method of connecting connector post 40 to brackets 30 is preferred because it places connector post 40 within slot 23 and therefore generally out of view, which is more esthetically pleasing than if it were exposed. The length of connector post 40 is adjustable so that adjustable bar 38 is correctly positioned within slot 23 when back edge 34 is positioned up against surface 20 of wall panel 18.

A tapped blind hole 45 is provided longitudinally through connector post 40 at the non-slotted end thereof. Adjustable bar 38 is attached to connector post 40 by means of screw 39 which fits through aperture 46 and into threaded hole 45. Aperture 46 is a clearance hole and, accordingly, bar 38 may be rotated and fixed in place in any position relative to the vertical plane of bracket 30. As also explained below, the angle or fixed location of adjustable bar relative to the vertical plane of bracket 30 comprises the angle of slot 23 relative to a horizontal plane. In this manner, adjustable bar 38 is positioned perpendicularly transverse to the longitudinal axis of slot 23 while bracket 30 is positioned in a vertical plane. This arrangement is shown in FIG. 4 where angled slot 23 is a typical diagonally oriented slot.

A cam means 50 is provided in bracket 30 to secure bracket 30 to wall panel 18. Cam means 50 and adjustable bar 38 are spaced from each other along the back edge 34 of bracket 30. Cam means 50 is receivingly engaged within a circular cutout 51 in back edge 34. Cam means 50 comprises a cylindrical member having a flat surface 53 extending along the length thereof. A centrally located recessed groove 52 extends around the circumference of cam means 50 and is sized such that cam means 50 at groove 52 fits snugly within and is rotatable about cutout 51. A transverse slot 54 in cam means 50 provides a convenient means for insertion of a tip of a screw driver to cause cam means 50 to be rotated within cutout 51 and thereby lock bracket 30 in slot 23. Such attachment also prevents the bracket from being removed by unauthorized persons. Cam means 50 and cutout 51 are similar to the same features shown in my U.S. Pat. No. 4,065,088. Cam means 50 as used in the present invention serves to lock bracket 30 within slot 23 by a combination of adjustable bar 38 and back edge 34, which bear, respectively, against the inner surface or surfaces 27 of slot 23 and the outer surface 20 of wall panel 18. An elastic "U" shaped member 55 may be attached to back edge 34 to prevent the bracket from marring the surface of wall panel 18.

Figure 5:
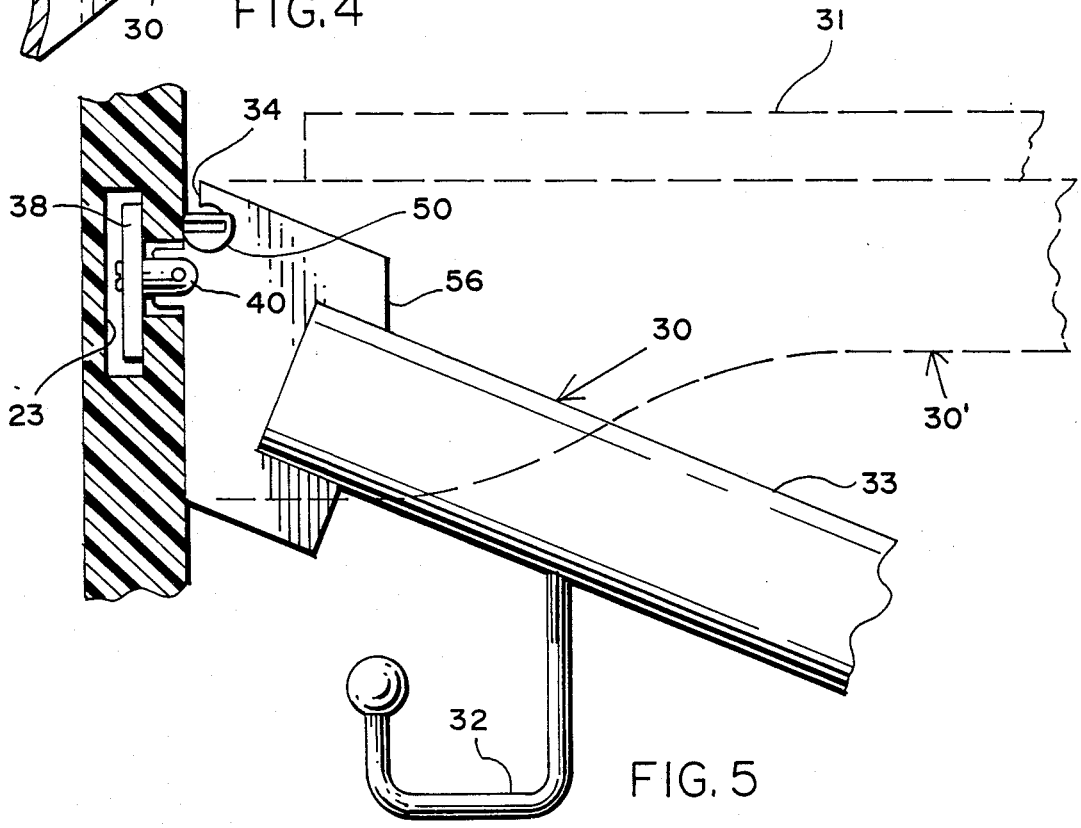
FIG. 5 shows a cross-sectional view of another embodiment of the improved bracket arrangement according to the present invention.

In FIG. 5 bracket 30 is shown in place in an angled slot 23 which is substantially horizontally oriented. The relative locations of back edge 34 and adjustable bar 38 as cinched in place by cam means 50 is shown. Also depicted is the right angle relationship of the longitudinal axis of adjustable bar 38 as compared to the longitudinal axis of slot 23. Such arrangement allows bracket 30 to be maintained at a perfectly vertical position. During installation of bracket 30 to slot 23, an exact degree of perpendicularly of adjustable bar 38 relative to slot 23 is not necessarily required. Because of the difference in length between adjustable bar 38 and the width of slot 23 at back portion 25 such difference in perpendicularity is permissible. When installing bracket 30, bar 38 is fixed in position relative to the angle of slot 23. Bar 38 is then aligned with slot 23 and is inserted therein. Then bracket 30 is rotated to a vertical position which orients bar 38 transverse to slot 23. Then cam means 50 is rotated thereby locking bracket 30 in a vertical position.

In the event that slots 23 comprise an "L" type of slot as shown in FIG. 2A, then the adjustable bar 38' shown in FIG. 3A is to be used. Adjustable bar 38' comprises approximately one-half of bar 38 and extends only to one side of bracket 30. Adjustable bar 38' is attached to connector post 40 in the same manner as adjustable bar 38.

It is to be noted that the length of connector post 40 and the thickness of adjustable bars 38 and 38' are to be consistent with the size of slot portions 25 and 25' and the depth thereof within wall panel 18 so that a snug fit is effectuated between the back edge 34 of bracket 30 and the front face 20 of wall panel 18.

In the event that bracket 30 is to be connected to a vertically oriented slot 23, a fixed rod 36 (shown in phantom in FIG. 3) may be advantageously used to prevent back edge 34 from fitting within slot 23 and causing bracket 30 to angle downward. Fixed rod 36 may be fitted within an aperture 37 at the lower portion of the base of bracket 30 at back edge 34. Fixed rod 36 extends perpendicularly from aperture 37 on either side of bracket 30 by approximately the same length. The overall length of fixed rod 36 may be approximately three times the width of opening 24 of slot 23. Fixed rod 36 may include a knurled portion 35 which allows a light press fit of rod 36 in aperture 37 and, therefore, easy installation and removal by hand. On the other hand, the non-use of a fixed rod 36 in a vertically oriented slot 23 allows an inclined position of bracket 30 which is advantageous when the bracket is being used as a waterfall bracket.

Bracket 30 may comprise a back portion 56 to which is attached a front portion 57. Back portion 56 may thus comprise a bracket adapter which allows any appropriate front portion 57 to be attached thereto consistent with the end use of the bracket. This allows the inventive bracket arrangement to be used to hang virtually any object to wall panel 18. For example, the front portion 57 may comprise a waterfall type of bracket, a slant type, display arms, etc.

Figure 7:
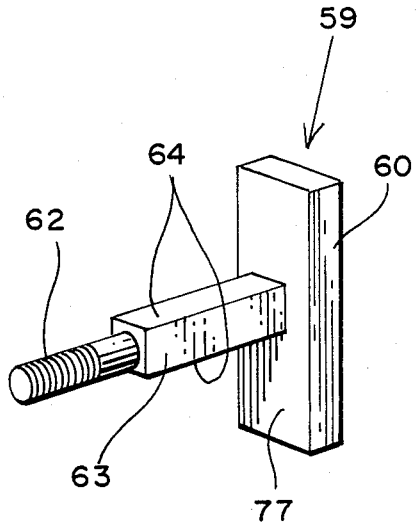
FIG. 7 is an isometric view of the adjustable bar of the embodiment of FIG. 5; and, FIG. 8 is an isometric view of the disk of FIG. 5 used to adjust the position of the bar of FIG. 5.
Figure 6:
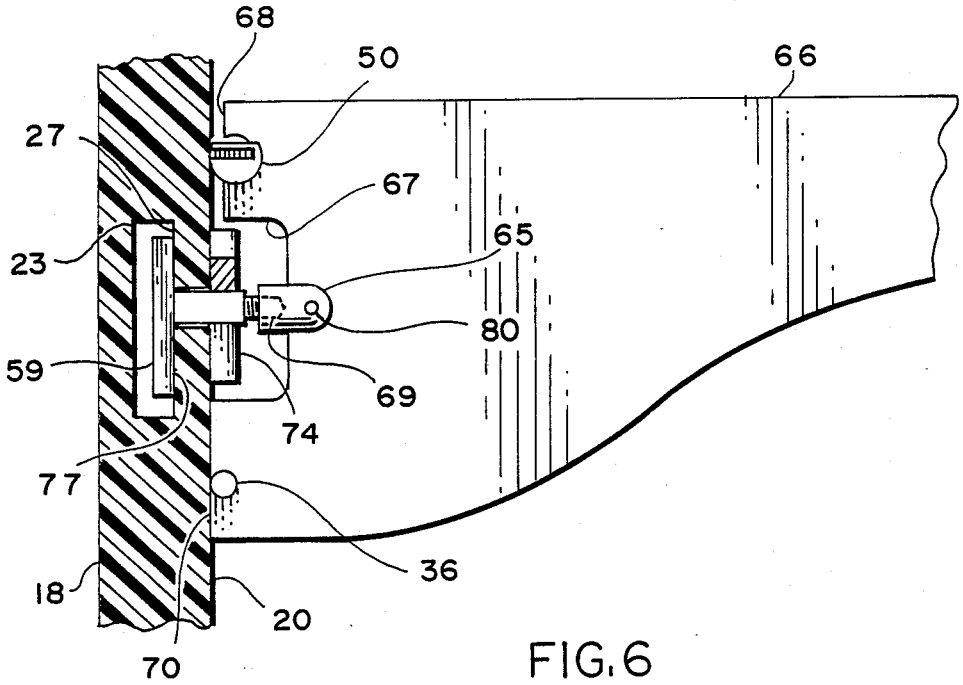
FIG. 6 shows a cross-sectional view of another embodiment of the improved bracket arrangement according to the present invention.
Figure 8:
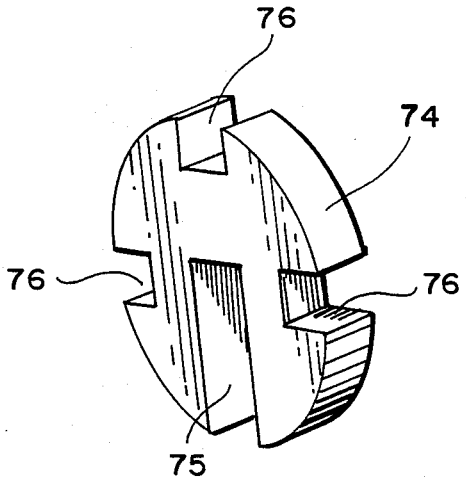
FIG. 8A shows another embodiment of the disk of FIG. 5 used to adjust the position of the bar of FIG. 5.

FIGS. 6, 7 and 8 show another embodiment of the improved bracket arrangement as provided by the present invention. In this embodiment an adjustably positionable bar 59 includes a bar portion 60 and a shaft portion, the latter comprising a threaded end 61 and an intermediate portion 63. Intermediate portion 63 has at least two oppositely disposed flat surfaces 64 thereon. A post connector 65 is fitted to bracket 66 within a cutout 67 provided in the upper back edge 68 thereof. Post connector 65 includes a slot which fits over the thickness of bracket 66 and is attached to bracket 66 by a pin 80 as in the previous embodiment. In this embodiment, however, post connector 65 does not fit within slot 23 and is, therefore, exposed to view. The threaded end 62 of bar 59 is threadingly engaged within a threaded opening 69 in the end of post connector 65. As in the previous embodiment, a cam means 50 is used to firmly secure bracket 66 to wall panel 18. Cam means 50 again operates to hold bracket 66 in place by a combination of the wedging provided by cam means 50, bar 59 and lower back edge 70 of bracket 66.

In the embodiment presented in FIGS. 6, 7 and 8 the adjustability provided by the threaded shaft of bar 59 eliminates the need to pre-match the location and size of the bar with the location and size of the slot 23. Bar 59 may simply be rotated in or out of threaded hole 69 so as to position bar 59 up against surfaces 27 of slot 23 when lower back edge 70 is up against the outer surface 20 of of wall panel 18. Then, cam means 50 may be rotated to firmly wedge bracket 66 in a fixed vertical position.

A circular plate member 74 is fitted to the intermediate portion 62 of bar 59 for purposes of orienting bar portion 60 transverse to the axis of slot 23 when bracket 66 is being finally installed. Plate member 74 comprises a circular disc having an elongated cutout 75 extending radially from the circumferential periphery thereof toward and slightly past he center thereof. The width of cutout 75 is slightly greater than the across-the-flats dimension between faces 64 of bar 59 so that plate 74 may fit over the intermediate portion 63 of bar 59. Additional but smaller radial cutouts 76 are provided around the circumferential of plate 74 as shown in FIG. 8 which serve to allow plate 74 to be rotated by an appropriate tool such as the tip of a screwdriver.

When installing the embodiment depicted in FIG. 6, bar 59 is threaded into post 65. Then, with the axis of bar portion 60 aligned with the axis of slot 23, bracket 66 is moved toward wall panel 18 and bar portion 60 is inserted into slot 23. Bracket 66 is then oriented in a vertical position. Plate 74 is then rotated so as to rotate bar 59 until back edge 70 is up against surface 20 of wall panel 18 and face 77 of bar portion 60 is up tight against surfaces 27 of slot 23. Then while still holding bracket 66 in a vertical position, plate 74 is rotated backward until bar portion 60 is substantially transverse to the axis of slot 23. Cam means 50 is then rotated to the position shown in FIG. 6, which action firms up the installed position of bracket 66 vertically against wall panel 18.

Figure 8A:
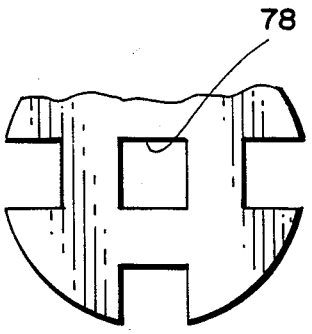

It is to be noted that plate 74 is convenient but not essential to the embodiment of FIG. 6. Instead of using plate 74 to rotate bar member 59, a suitably sized wrench may be used. On the other hand, should plate 74 be utilized, it may also be held captive over the intermediate shaft portion 63 by using a square hole 78 (FIG. 8A) in place of cutout 75.

In the event that slot 23 comprises a vertical slot and it is not desirous to use a slanted bracket, a rod 36 may be used at the bottom back edge 70 as in the previous embodiment. Also, as in the previous embodiment, bracket 66 may comprise any of the well known brackets used to display and hang various goods to a wall arrangement.

While the invention has been described, disclosed, illustrated and shown in certain terms or certain embodiments or modifications which is has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. A bracket and slotted wall system comprising a wall having at least one elongated slot extending along said wall and in any direction therealong, said slot comprising an entrance opening and an inside opening which is wider than said entrance opening, and at least one flange member over said inside opening extending from a side thereof to said entrance opening a bracket attached to said at least one elongated slot, against said wall and extending away from said wall, said bracket having a back portion comprising a flat plate having a first axis along a plane of said flat plate and a second axis perpendicular to the plane of said flat plate positioning means attached to said back portion of said bracket and fitting within said inside opening of said slot for positioning said bracket such that said flat plate is positioned vertically and said second axis is positioned parallel to said wall, said positioning means comprising a bar member, and means for attaching said bar member to said back portion of said bracket for allowing said bar member to rotate relative to said bracket, whereby the longitudinal axis of said bar member may be positioned transverse to the longitudinal axis of said slot to which the bracket is to be attached, and cam means attached to said back portion of the bracket for fixedly securing said bracket in said position against said wall by clamping said flange member of the slot between said cam, a back edge of said bracket and said positioning means.

2. A bracket adapted to be mounted to a panel having at least one elongated slot, said slot extending in said panel in any direction therealong and having an inside opening which is wider than an entrance opening such that at least one flange member exists over said inside opening and extends from a side thereof to said entrance opening said bracket being attachable to said slot in the panel and extending away therefrom, said bracket having a back portion comprising a flat plate having a first axis along a plane parallel to said flat plate and a second axis perpendicular to the plane of said flat plate positioning means attached to said back portion of the bracket and fitting within said inside opening of the slot such that said first axis is positionable vertically and said second axis is positionable parallel to said wall to which the bracket is to be attached, said positioning means comprising a bar member, and means for attaching said bar member to said back portion of said bracket for allowing said bar member to rotate relative to said bracket, whereby the longitudinal axis of said bar member may be positioned transverse to the longitudinal axis of said slot to which the bracket is to be attached, and cam means attached to said back portion of the bracket for fixedly securing the bracket in said position against said panel by clamping the flange member between said cam means, a back edge of the bracket and said positioning means.

3. The apparatus of claim 1 or 2, wherein said bracket includes a front portion which extends in an upwardly slanted direction away from said wall.

4. The apparatus of claims 1 or 2, wherein said positioning means further comprises a connecting member attached at one end to said back portion of said bracket, and at a second end to said bar member, said connecting member extending from said back portion of said bracket and being capable of fitting through said entrance opening of said slot to said bar member attached thereto.

5. The apparatus of claim 4, wherein said means for allowing rotation of said bar member comprises a threaded screw connecting said bar member to said connecting member whereby the angle of the longitudinal axis of said bar member may be positioned at a predetermined angle relative to the vertical axis of said bracket and then locked in place at said predetermined location.

6. The apparatus of claims 1 or 2, wherein said at least one slot has a tee-shaped cross-sectional configuration and said bar member attached to the back portion of said bracket extends in opposite directions from said back portion such that it is capable of fitting within said inside opening of said slot.

7. The apparatus of claims 1 or 2, wherein said at least one slot has an L-shaped cross-sectional configuration and said bar member attached to the back portion of said bracket extends only in one direction away from said back portion whereby said bar member is capable of fitting within said inside opening of said slot.

8. The apparatus of claim 4, wherein said back portion of said bracket contains a cutout at the location of the attachment of said bar member to the back portion of said bracket, said connecting member having at least two oppositely disposed flat surfaces provided thereon, and a threaded end portion, said threaded end portion being threadingly connected to said bracket at the cutout portion thereof, and a disk member having a slot therein for fitting over said flat surfaces on said connector whereby rotation of said disk member causes rotation of said bar member for wedgedly containing the flange member of said slot between said bar member and the back edge of said bracket.

9. The apparatus of claim 1 or 2, wherein said bracket includes a front portion which extends in a horizontal direction away from said wall.

10. The apparatus of claim 1 or 2, wherein said bracket includes a front portion which extends in a downwardly slanted direction away from said wall.

* * * * *